United States Patent [19]

Goto et al.

[11] Patent Number: 4,913,055

[45] Date of Patent: Apr. 3, 1990

[54] CARTRIDGE FOR EXPLOSIVELY OPERATED INDUSTRIAL TOOLS

[75] Inventors: Kazuhiro Goto, Markham; Ross L. Mair, Barrie; Reid McBain, Agincourt, all of Canada; Douglas J. Leiby, Enola, Pa.; Mitchell G. Carpenter, Ancaster, Canada

[73] Assignee: AMP Incorporated, Harrisburg, Pa.

[21] Appl. No.: 394,605

[22] Filed: Aug. 16, 1989

[51] Int. Cl.[4] ..... F42B 5/26

[52] U.S. Cl. ..... 102/470; 102/531

[58] Field of Search ..... 102/469, 470, 530, 531; 89/1.14

[56] References Cited

U.S. PATENT DOCUMENTS

| | | | |
|---|---|---|---|
| 2,061,641 | 11/1936 | Tinkham | 220/3 |
| 2,685,252 | 8/1954 | Catlin | 102/45 |
| 3,296,792 | 1/1967 | Hedberg et al. | 60/26.1 |
| 3,343,294 | 9/1967 | Wahl | 42/1 |
| 4,233,903 | 11/1980 | Lage | 102/42 R |
| 4,353,304 | 10/1982 | Hubsch et al. | 102/470 |
| 4,600,123 | 7/1986 | Galbraith | 222/3 |

*Primary Examiner*—Charles T. Jordan
*Assistant Examiner*—Rochelle Lieberman
*Attorney, Agent, or Firm*—Allan B. Osborne

[57] ABSTRACT

An improved cartridge for use with explosively-operated industrial tools. More particularly the cartridge includes a gas check having a rigid washer between opposite ends which causes the deformation of the gas check in cooperation with the gases from burning powder.

8 Claims, 3 Drawing Sheets

CARTRIDGE FOR EXPLOSIVELY OPERATED INDUSTRIAL TOOLS

FIELD OF THE INVENTION

The invention disclosed herein relates to cartridges for explosively operated industrial tools and more particularly to the gas check within the cartridge which contains the primer.

BACKGROUND OF THE INVENTION

It is known from U.S. Pat. No. 3,007,409 to provide an explosive cartridge for industrial tools in which a plug or gas check containing a detonating primer is positioned near the base of the cartridge shell with the powder between the plug and base. The primer is positioned in the end of the plug facing the open end of the shell and is detonated by a firing pin on a ram entering the shell from the open end. The gases from the ignited powder pushes on the ram which engages a work piece.

It is also known from U.S. Pat. No. 3,155,039 to provide forwardly projecting prongs on the plug or gas check and which are disposed about the primer. The prongs resist compression and thus protect the primer from accidental engagement and detonation by a rearwardly moving first pin. However, the prongs are readily bent over sideways by a rotary motion between the prongs and firing pin and thus permit engagement and detonation.

It is now proposed to provide an improved cartridge having therein a gas check which deforms during the detonation thereof to trap and retain the primer.

SUMMARY OF THE INVENTION

According to the invention, the cartridge includes a shell and a gas check positioned in the shell with powder between the gas check and base. The gas check, made of plastics material, includes an aperture in one end for the primer and a rigid washer between the primer and another end. The washer, in cooperation with the gases from the powder when ignited, causes the gas check to deform and thereby retain the primer in the aperture.

DESCRIPTION OF THE INVENTION

Figure 1:
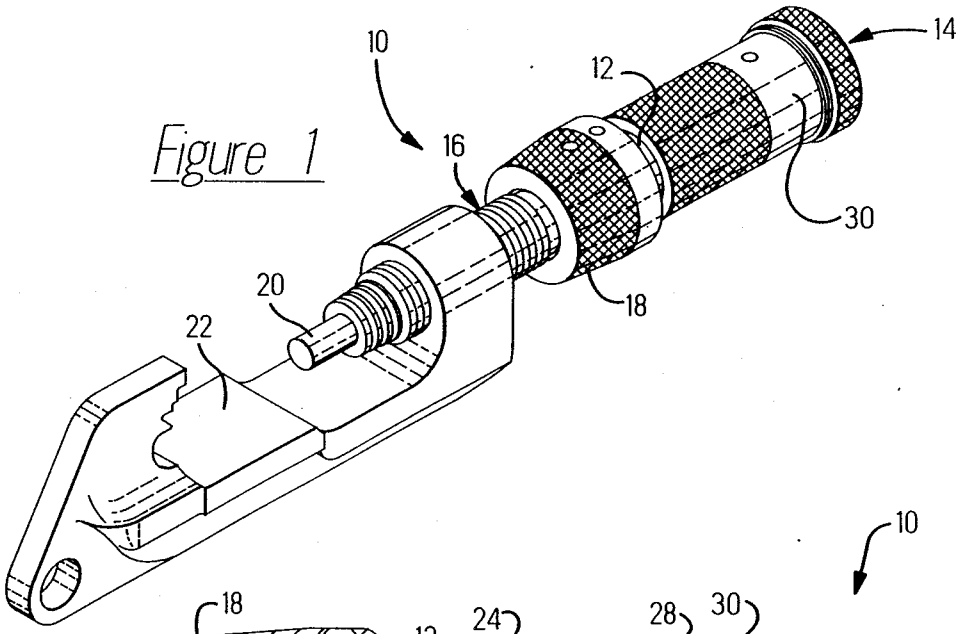
FIG. 1 is a perspective view of an industrial tool of the type using the cartridge of the present invention.
Figure 2:
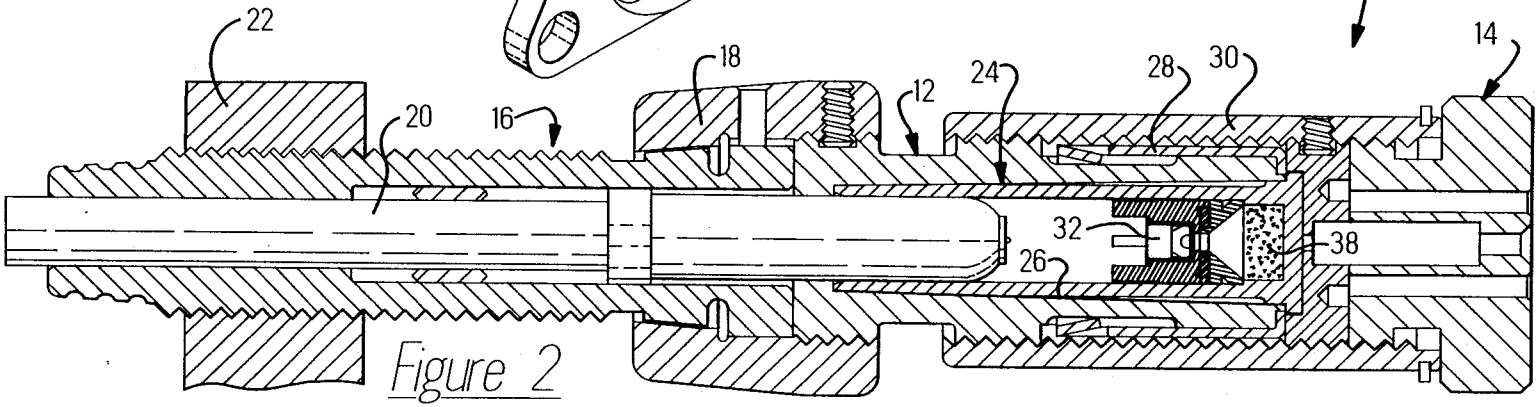
FIG. 2 is a cross-sectional view of the tool of FIG. 1 with the cartridge of the present invention inserted therein.

The explosively operated industrial tool 10 shown in FIGS. 1 and 2 includes a breech 12, breech cap 14 removably mounted at one end of breech 12, barrel 16, attached to the other end of coupling 18 and ram 20 which is slidingly positioned in both barrel 16 and breech 12. Platform 22, threadedly secured to the free end of barrel 16, holds a work piece (not shown) for work to be done thereon by ram 20 as it is driven forward by gases generated by detonating cartridge 24.

As shown in FIG. 2, breech 12 includes chamber 26 which receives cartridge 24 in one end and ram 20 in the other end. Cartridge ejector 28 is located on breech 12 and within sleeve 30 which provides a threaded aperture for breech cap 14.

In operation, breech cap 14 is replaced after cartridge 24 is placed in chamber 26 and tool 10 is struck sharply on breech cap 14 by a hammer. The force of the blow causes ram 20 to slide rearwardly into the open end of cartridge 24 and strike primer 32 positioned in gas check 36. The exploding primer ignites powder 38 which produces the gases (not shown) to drive ram 20 forcefully forward.

Figure 3:
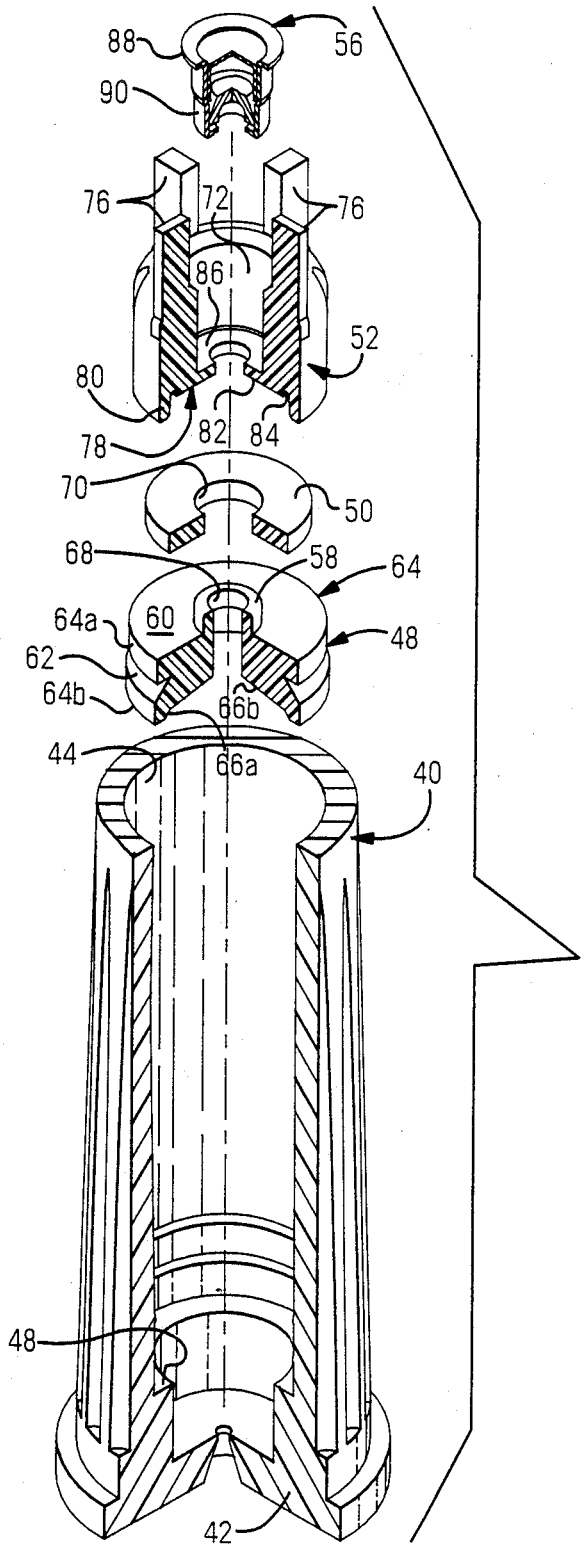
FIG. 3 is an exploded, cut-away view of the cartridge.
Figure 3A:
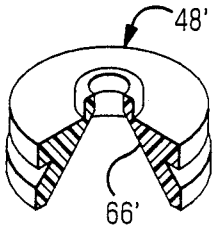
FIG. 3*a* is an exploded view of the lower section.
Figure 4:
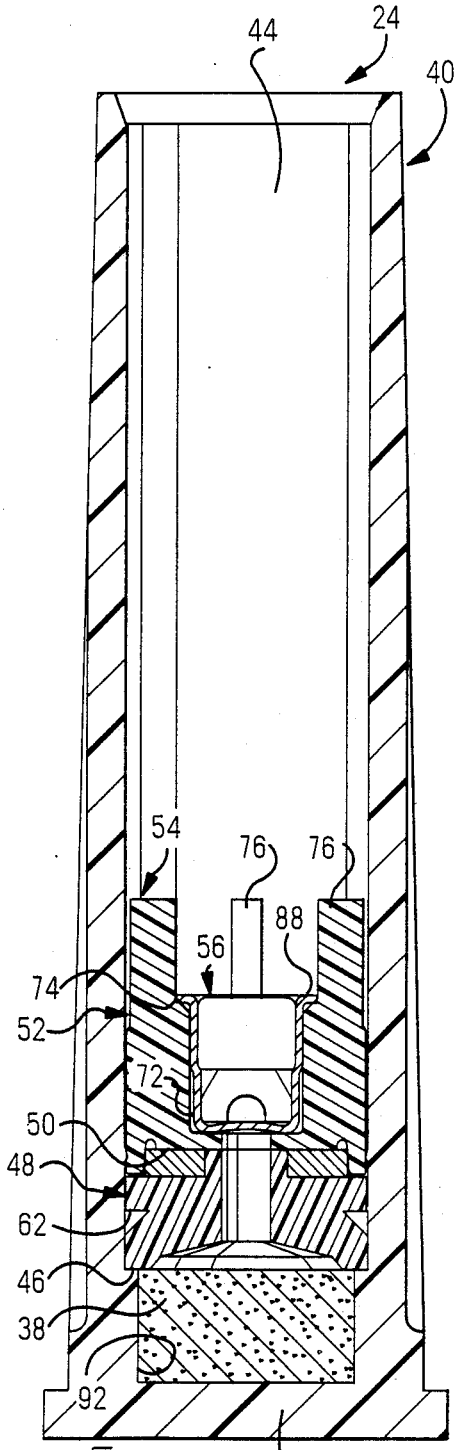
FIG. 4 is a view of the assembled cartridge prior to being detonated.

As shown in FIG. 3, the components of cartridge 24 includes tapered shell 40 having base 42 and open end 44. Internally, outwardly facing ledge 46 is provided near base 42. Other components are lower section 48, washer 50 and upper section 52, all of which comprise gas check 54 (FIG. 4) and primer 56. Shell 40 and gas check components 48,52 are molded with the preferred plastics material being polyethylene. Washer 50 is made from a rigid material such as cast iron or steel. Primer 56 is well known and does not need describing.

Lower section 48 is round as shown and is provided with a small diameter annular ring 58 rising from top surface 60. An annular groove 62, which is asymmetrically V-shaped, extends into side wall 64 to provide first and second wall portions 64*a*, 64*b* respectively. The double, truncated cone surface 66 of lower section 48 includes first and second tapered surfaces 66*a*, 66*b* respectively. First surface 66*a* is at an angle of about forty nine degrees relative to a horizontal line; e.g. top surface 60. Second surface 66*b* is at an angle of about fourteen degrees relative to a horizontal line. Opening 68 extends through ring 58 and surface 60 and opens in the space defined by tapered base surface 66.

Washer 50 is provided with an opening 70 which has a diameter equal to annular ring 58 on lower section 48.

Upper section 52 includes a cup-shape aperture 72 which is accessible from top surface 74. Four prongs 76, spaced around aperture 72, project outwardly therefrom. Base surface 78 includes an outer downwardly projecting flange 80, recessed surface 82 and groove 84 between flange 80 and recessed surface 82. Opening 86 opens out in aperture 72 and recessed surface 82. Recessed surface 82 has a diameter equal to the diameter of washer 50. Gas check 54 is shown as being formed from separate lower section 48, separate upper section 52 and washer 50. Although not shown, gas check 54 could be made by insert molding wherein section 48 and 52 would not be separate components.

Primer 56 includes rim 88 which projects outwardly laterally and cup shaped portion 90. Cartridge 24 is shown assembled in FIG. 4. Gas check 54 is assembled by pushing annular ring 58 on lower section 48 through opening 70 in washer 50 and then placing that subassembly into recessed surface 82 of upper section 52. The entire assembly is held together by the frictional fit between the three components 48,50 and 52. Primer 56 is placed in aperture 72 of upper section 52 with flange 88 resting on top surface 74.

A predetermined amount of a suitable gun powder 38 is placed in chamber 92 of shell 40 which is defined by base 42 and the interior walls below ledge 46. Gas check 54 is positioned on ledge 46 with prongs 76 and primer 56 facing open end 44 of shell 40.

Figure 5:
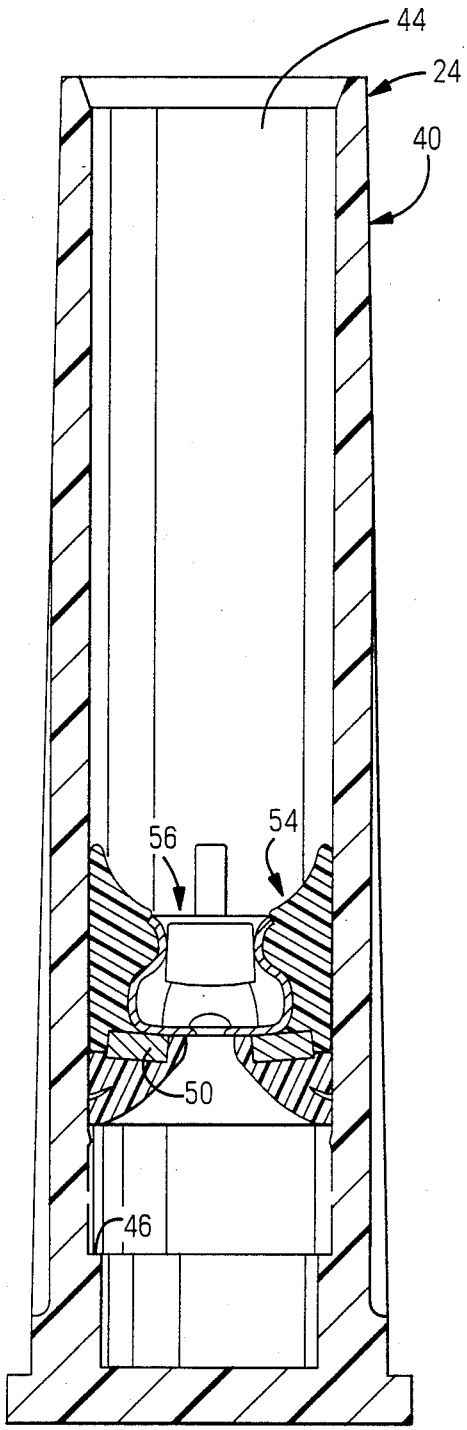
FIG. 5 is a view of the cartridge after being detonated.

FIG. 5 shows cartridge 24 after primer 56 had been detonated and powder 38 ignited. The expanding gases from burning powder 38 causes gas check 54 to deform as shown. The deformation is a result of the forces impinging on rigid washer 50. Gas check 54 and primer 56 temporarily caught between ram 20 and washer 50, deforms as shown and primer 56 becomes wedged in the now deformed upper section 52. Notice that gas check 54 is squeezed into a smaller volume as a result and also that it moves a short distance towards opening 44. During this travel gases flow out from chamber 92 between the walls of shell 40 and gas check 56. In summary, lower and upper portions 48,52 respectively of gas check 54, being of a plastics material, deforms around the rigid washer 50 and that primer 56, of plated mild steel, also deforms and becomes trapped in aperture 72. Tests indicate that forces of between 30 and 50 pounds, depending on the amount of powder 38, are required to pry spent primer 56 away from deformed gas check 54. Further, the double cone base surface 66 provides a balance between the radial and axial forces which reduce or eliminate excessive forces acting against the wall of shell 40.

As can be discerned, an improved cartridge for a explosively-operated industrial tool has been disclosed. The cartridge includes a two piece gas check with a rigid washer therebetween which provides the catalysts whereby the gas check deforms to retain the primer therein and to improve the escape of gases from the shell.

We claim:

1. An improved cartridge for use with explosively operated industrial tools, said cartridge comprising:

an elongated shell open at one end and closed at a base end, said shell having a chamber adjacent said base end;

powder deposed in said chamber;

a gas check of plastics material and having an outwardly open aperture in one end and a rigid washer between said aperture and another end, said gas check positioned in said shell adjacent said powder with said aperture facing the open end; and a primer positioned in said aperture.

2. The cartridge according to claim 1 wherein said gas check includes a lower section, and an upper section with said washer therebetween and said aperture being in said upper section.

3. The cartridge according to claim 2 wherein said washer includes an opening therethrough which receives an annular ring projecting from a surface of said lower section.

4. The cartridge according to claim 3 wherein said upper section includes a recessed surface at an end opposite from said aperture and which receives said washer.

5. The cartridge according to claim 2 wherein said lower section includes a flat top surface and base surface, said base surface in tandem, having two tapered surfaces of differing angles relative to said top surface.

6. An improvement to a cartridge for use with explosively operated industrial tools and having an elongated shell open at one end and a primer therein detonated by means entering the open end, said improvement comprising a gas check formed of separate upper and lower sections with a washer therebetween said upper section having an aperture in a free end for receiving a primer and further having, in cooperation with said lower section means for retaining said washer therebetween.

7. The improvement according to claim 6 wherein said lower section includes a base surface at a free end with said base surface being a double truncated-cone-shaped.

8. The improvement according to claim 7 wherein the double truncated-cone-shape includes first and second tapered surfaces with each surface being tapered at a different angle relative to the other.

* * * * *